US010961101B2

(12) United States Patent
Clark

(10) Patent No.: US 10,961,101 B2
(45) Date of Patent: Mar. 30, 2021

(54) BEVERAGE SHOTGUNNING DRINKING APPARATUS

(71) Applicant: Chug Co, LLC, Flint, TX (US)

(72) Inventor: Kyle Alan Clark, Flint, TX (US)

(73) Assignee: Chug Co, LLC, Flint, TX (US)

( * ) Notice: Subject to any disclaimer, the term of this patent is extended or adjusted under 35 U.S.C. 154(b) by 0 days.

(21) Appl. No.: 16/243,886

(22) Filed: Jan. 9, 2019

(65) Prior Publication Data

US 2019/0218087 A1 Jul. 18, 2019

Related U.S. Application Data

(60) Provisional application No. 62/617,010, filed on Jan. 12, 2018.

(51) Int. Cl.

| | |
|---|---|
| ***B67B 7/00*** | (2006.01) |
| ***A47G 21/18*** | (2006.01) |
| ***B67B 7/16*** | (2006.01) |
| ***A47G 19/22*** | (2006.01) |

(52) U.S. Cl.

CPC ..... *B67B 7/26* (2013.01); *A47G 19/22* (2013.01); *A47G 21/18* (2013.01); *B67B 7/16* (2013.01); *A47G 19/2227* (2013.01)

(58) Field of Classification Search

CPC ..... B67B 7/26

See application file for complete search history.

(56) References Cited

U.S. PATENT DOCUMENTS

| | | | | |
|---|---|---|---|---|
| 1,986,337 | A | 1/1935 | Harris et al. | |
| 2,040,585 | A | 5/1936 | Wiswell | |
| 2,759,634 | A | 8/1956 | O'Neill | |
| 2,828,884 | A | 4/1958 | McDaniel | |
| 3,006,303 | A | 10/1961 | Young | |
| 3,552,241 | A | 1/1971 | Steiner | |
| 3,705,666 | A | 12/1972 | Nelson et al. | |
| 3,805,643 | A | 4/1974 | Turner et al. | |
| 4,414,866 | A | 11/1983 | Kichijyo | |
| 4,442,735 | A | 4/1984 | Chance et al. | |
| 4,829,618 | A | 5/1989 | McKee | |
| 5,048,723 | A | 9/1991 | Seymour | |
| 5,077,850 | A | 1/1992 | Brubaker | |
| 5,403,053 | A | 4/1995 | Zareck | |
| 5,630,529 | A * | 5/1997 | Chlupp | B67D 3/0083 222/1 |
| 6,386,069 | B1 | 5/2002 | Olivera et al. | |
| 6,502,481 | B1 | 1/2003 | Lin | |

(Continued)

FOREIGN PATENT DOCUMENTS

| | | | |
|---|---|---|---|
| DE | 2656486 A1 * | 6/1978 | B67B 7/26 |
| WO | WO-8002546 A1 * | 11/1980 | B67D 3/045 |

*Primary Examiner* — Stephen Choi

(74) *Attorney, Agent, or Firm* — Conley Rose, P.C.; Brandt D. Howell

(57) ABSTRACT

An apparatus comprises a body shell including a proximate end, a distal end, and a cylindrical passage. The apparatus also includes a piercing tube, which is slidably positioned within the cylindrical passage of the body shell. The piercing tube includes a proximate end including a piercing element with a central opening. The piercing tube also includes a distal end including a drinking spout. The piercing tube also includes a drink passage between the central opening of the piercing element and the drinking spout.

9 Claims, 9 Drawing Sheets

(56) References Cited

U.S. PATENT DOCUMENTS

| | | | | |
|---|---|---|---|---|
| 6,715,266 | B2 | 4/2004 | Browning | |
| 6,766,933 | B1 * | 7/2004 | Wang | A62B 3/005 173/202 |
| 7,028,359 | B2 | 4/2006 | Mazur | |
| 7,028,874 | B2 * | 4/2006 | Lin | A62B 3/005 173/202 |
| 8,667,867 | B2 | 3/2014 | Mills et al. | |
| 8,707,828 | B2 | 4/2014 | Ward | |
| 8,740,030 | B2 * | 6/2014 | Purdy | A62B 3/005 225/103 |
| 9,659,554 | B1 | 5/2017 | Determan | |
| 2004/0031770 | A1 | 2/2004 | Gardner et al. | |
| 2004/0089105 | A1 | 5/2004 | Saviano et al. | |
| 2004/0238563 | A1 | 12/2004 | Lin | |
| 2005/0011909 | A1 * | 1/2005 | Hanell | B67B 7/26 222/83 |
| 2006/0261064 | A1 | 11/2006 | Holley, Jr. | |
| 2007/0006684 | A1 | 1/2007 | Taylor | |
| 2007/0262079 | A1 | 11/2007 | Paris et al. | |
| 2008/0060479 | A1 | 3/2008 | Nelson | |
| 2008/0110298 | A1 | 5/2008 | Monk | |
| 2009/0230141 | A1 * | 9/2009 | Haney | B65D 25/48 220/745 |
| 2011/0119835 | A1 | 5/2011 | Bates et al. | |
| 2011/0139787 | A1 | 6/2011 | Endert | |
| 2014/0109727 | A1 | 4/2014 | Long | |
| 2015/0251888 | A1 | 9/2015 | Pelgrom | |
| 2015/0298953 | A1 | 10/2015 | Rocchi | |
| 2016/0145087 | A1 | 5/2016 | Jury | |

* cited by examiner

BEVERAGE SHOTGUNNING DRINKING APPARATUS

CROSS-REFERENCE TO RELATED APPLICATIONS

This patent application claims the benefit of U.S. Provisional Patent Application No. 62/617,010, filed Jan. 12, 2018 by Kyle Alan Clark, and titled "Beverage Can Opener And Fluid Drinking Apparatus," which is hereby incorporated by reference.

BACKGROUND

For recreation and competition reasons, some individuals consume beverages from beverage cans via a method known as shotgunning. When shotgunning a beverage, such as a beer, an individual may position a beverage can horizontally and puncture the beverage can with a sharp object such as a screwdriver, a key, etc. The individual positions their mouth over the punctured hole, tilts the beverage can vertically, and opens the beverage can. By providing two openings into the beverage can, air can enter the beverage can via the upper opening as the beverage pours from the lower opening. This allows air pressure in the beverage can to continuously equalize, which in turn prevents pressure differentials from reducing the flow speed of the beverage. The net result is that the beverage pours rapidly from the beverage can. Shotgunning can create multiple concerns. For example, some of the beverage may spill from the punctured hole in the beverage can due to a poor seal between the hole and the individual's mouth. As another example, an irregularly punctured hole may contain sharp edges which can cut the individuals mouth. As yet another example, the beverage can may be unsanitary.

SUMMARY

In an example embodiment, the disclosure includes an apparatus that comprises a body shell including a proximate end, a distal end, and a cylindrical passage. The apparatus also includes a piercing tube, which is slidably positioned within the cylindrical passage of the body shell. The piercing tube includes a proximate end including a piercing element with a central opening. The piercing tube also includes a distal end including a drinking spout. The piercing tube also includes a drink passage between the central opening of the piercing element and the drinking spout.

In another example embodiment, the disclosure includes a method that comprises sliding a piercing tube into an armed position relative to a body shell. The method further comprises abutting a proximate end of the body shell against a sidewall of a beverage can. The piercing tube slides through the body shell into a can engagement position by piercing the sidewall of the beverage can with a piercing element of the piercing tube. Further, a beverage is funneled through the sidewall of the beverage can via a drink passage in the piercing tube.

For the purpose of clarity, any one of the foregoing embodiments may be combined with any one or more of the other foregoing embodiments to create a new embodiment within the scope of the present disclosure.

These and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein is a beverage shotgunning drinking apparatus. The apparatus includes body shell with a piercing tube slidably positioned inside the body shell. The piercing tube includes a piercing element on a proximate end and a drinking spout on a distal end. The piercing element can pierce the side wall of a beverage can and funnel the beverage to the user via the drinking spout. Accordingly, a user may not place their mouth directly on the beverage can, which mitigates the possibility of cuts. The body shell contains a can seal which can be positioned on the side wall of the beverage can. The piercing tube can slide into the beverage can sidewall through the can seal, which may create a seal and mitigate beverage spillage. A compression spring is coupled to the piercing tube and the body shell. The compression spring may provide the force to pierce the beverage can sidewall with the piercing tube. For example, a trigger can be provided on an outer wall of the body shell. The piercing tube can be slid through the body shell (extending the compression spring) and maintained in place by abutting the trigger to the piercing tube. The user may place the can seal against the beverage can sidewall and actuate the trigger. The compression spring then retracts and forces the piercing tube to pierce the beverage can. An engagement member may be provided on the body shell to engage to a lower rim of the beverage can. The piercing tube may include ribs, which may be used to catch a metal plug in the event that such a plug is created and detached from the beverage can by the piercing process. The apparatus may also include a key ring attachment that may be coupled to maintain the apparatus in a stowed position when not in use. For example, the key ring attachment may be positioned to abut both a lip of the piercing tube and the distal end of the body shell, which, in conjunction with the compression spring, prevents the piercing tube from sliding when stowed. The engagement member may also be employed as a bottle opener. Further, the piercing tube can be configured to act as a whistle when the trigger latch is actuated.

Figure 1:
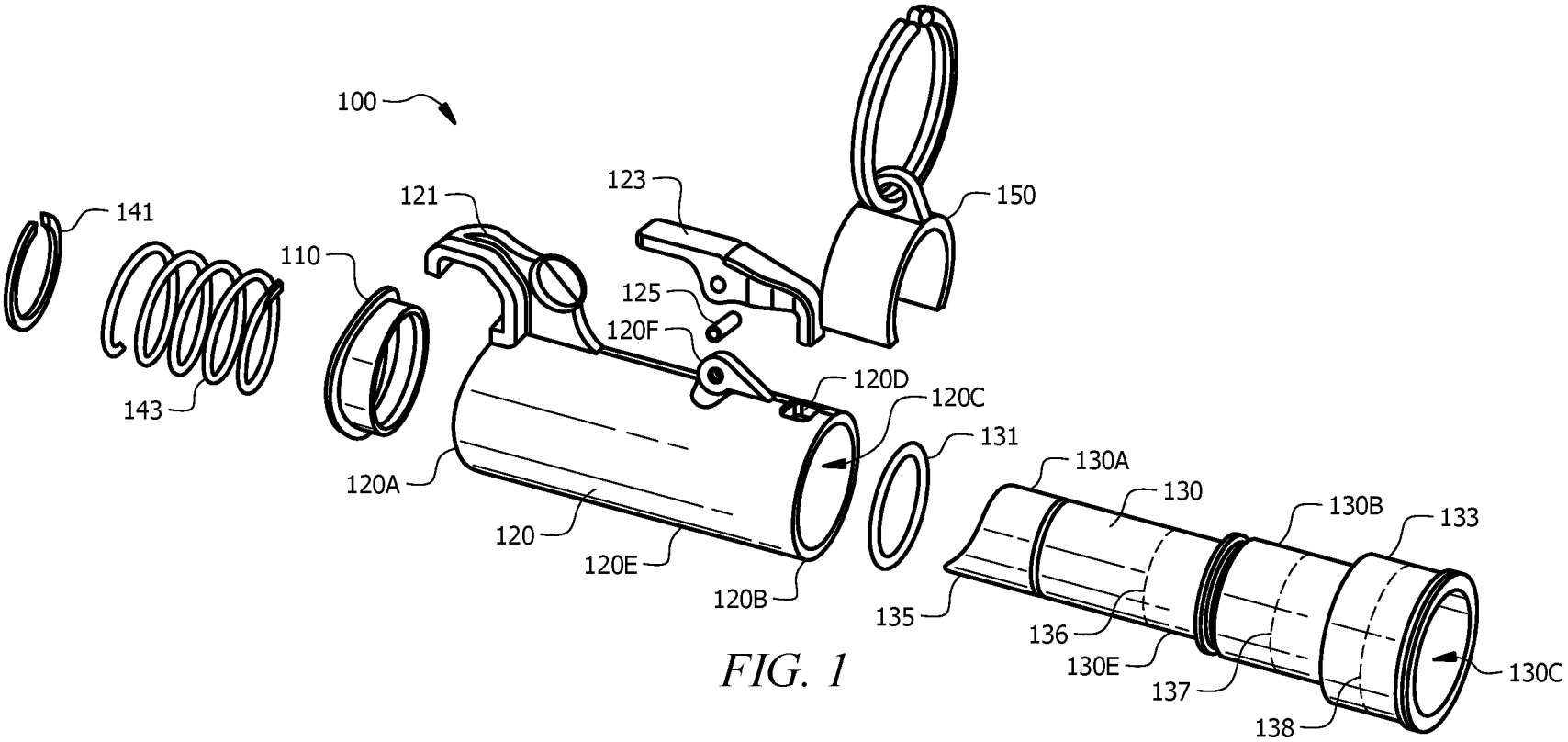
FIG. 1 is an exploded view of an example beverage shotgunning drinking apparatus.

FIG. 1 is an exploded view of an example beverage shotgunning drinking apparatus 100. The beverage shotgunning drinking apparatus 100 includes a body shell 120 and a piercing tube 130. The piercing tube 130 is slidably positioned within the body shell 120. This allows the user to hold the body shell 120, slide the piercing tube 130 into a beverage can, and drink the beverage that pours through the piercing tube 130.

The body shell 120 includes a proximate end 120A, a distal end 120B, and a cylindrical passage 120C. The proximate end 120A and distal end 120B are included as labels to describe the usage of body shell 120 relative to other components. The cylindrical passage 120C is an opening that extends through the body shell 120 from the proximate end 120A to the distal end 120B. The cylindrical passage 120C is sized to accept the piercing tube 130 and associated components, such as a compression spring 143. The body shell 120 also includes a trigger opening 120D for use in conjunction with a trigger latch 123 and an outer wall 120E. The body shell 120 includes a can engagement member 121, which is positioned on the outer wall 120E of the proximate end 120A of the body shell 120. The can engagement member 121 is employed to engage (e.g., hook) the proximate end 120A of the body shell 120 to a beverage can. The can engagement member 121 may include a curvature sized to engage a lower rim of a beverage can. The body shell 120 can be made of any material capable of maintaining a predetermined shape when under pressure, such as when under pressure from a compression spring 143. For example, the body shell 120 may be made of plastic, metal, wood, glass, ceramics, stone, etc.

The piercing tube 130 is slidably positioned within the cylindrical passage 120C of the body shell 120. This allows the piercing tube 130 to slide into an armed position and into a can engagement position to pierce the sidewall of a beverage can. The piercing tube 130 includes a proximate end 130A and a distal end 130B, which are included as labels to describe the usage of the piercing tube 130 relative to other components. The proximate end 130A of the piercing tube 130 includes a piercing element 135 with a central opening. The piercing element 135 is sharpened to at least one point and may be rounded in order to create a rounded hole in the beverage can when engaged. It should be noted that, while the components described herein are rounded for simplicity, other shapes may be employed (e.g., square, triangular, etc.) without altering the functions described herein. Further, the piercing element 135 may contain an angled portion that is sharpened to a tip to allow puncturing of the beverage can. The piercing element 135 may be sharp enough to pierce aluminum but may be dull enough to avoid cutting skin absent significant pressure. In other examples, the piercing element 135 may contain multiple points. Once the beverage can is pierced, the beverage in the can may pour through the central opening of the piercing element 135. The piercing tube 130 also includes a drinking spout 133 with an opening positioned at the distal end 130B of the piercing tube 130. The piercing tube 130 also includes a drink passage 130C that extends between the central opening of the piercing element 135 and the drinking spout 133. The drink passage 130C serves to funnel the beverage from the central opening of the piercing element 135 to the opening in the drinking spout 133 to be imbibed by the user. The piercing tube 130 includes a first diameter 136 at the proximate end 130A, a second diameter 137 at the distal end 130B, and a third diameter 138 at the drinking spout 133. The first diameter 136 is smaller than the second diameter 137, and the second diameter 137 is smaller than the third diameter 138. The purposes of these diameter differences are discussed in more detail below. The piercing tube 130 can be made of any material capable of maintaining a predetermined shape when under pressure, such as when under pressure from a compression spring 143, and capable of maintaining shape while puncturing an aluminum can. For example, the piercing tube 130 may be made of plastic, metal, wood, glass, ceramics, stone, etc.

The beverage shotgunning drinking apparatus 100 also includes a compression spring 143, which is coupled to the body shell 120 and the piercing tube 130. For example beverage shotgunning drinking apparatus 100 may include a spring ring clip 141, which clips to a groove in the proximate end 130A of the piercing tube 130. The compression spring 143 extends around the proximate end 130A of the piercing tube 130 from the spring ring clip 141 to an inner ridge inside the cylindrical passage 120C of the body shell 120. Hence, the first diameter 136 at the proximate end 130A of the piercing tube 130 is sized to be surrounded by the compression spring 143. The compression spring 143 becomes compressed when the piercing tube 130 is pulled into an armed position. The compression spring 143 provides tension between the spring ring clip 141 and the cylindrical passage 120C when the piercing tube 130 is in the armed position, and hence provides force to bring the piercing element 135 of piercing tube 130 into a can engagement position when released. Specifically, when released, the compression spring 143 forces the piercing element 135 of the piercing tube 130 to pierce the sidewall of the beverage can. The compression spring 143 can be made of any material capable of being formed into a coil, and providing pressure when compressed or expanded beyond a preformed coiled shape. For example, the compression spring 143 may be made of metal or plastic. The spring ring clip 141 can be made of any material capable of maintaining a predetermined shape when under pressure, such as when under pressure from a compression spring 143. For example, the spring ring clip 141 may be made of plastic, metal, wood, glass, ceramics, stone, etc.

The beverage shotgunning drinking apparatus 100 also includes a trigger latch 123. The trigger latch 123 is rotatably coupled to an outer wall 120E of the body shell 120. For example, the outer wall 120E of the body shell 120 may include a latch connector 120F that connects to the trigger latch 123 via a latch pin 125. The trigger latch 123 can rotate to extend through the trigger opening 120D and abut against a first flange of the piercing tube 130 created by the difference between the first piercing tube diameter 136 and the second piercing tube diameter 137. Hence, the trigger latch 123 can be rotated to connect to the first flange and oppose the compression spring 143 in order to maintain the piercing tube 130 in the armed position. Further, the trigger latch 123 can be rotated out of the trigger opening 120D, which allows the compression spring 143 to act on the piercing tube 130, and hence pierce the beverage can. The trigger latch 123 can be made of any material capable of maintaining a predetermined shape when under pressure, such as when under pressure from a compression spring 143 via the piercing tube 130. For example, the trigger latch 123 may be made of plastic, metal, wood, glass, ceramics, stone, etc.

The beverage shotgunning drinking apparatus 100 also includes a can seal 110 attached to the proximate end 120A of the body shell 120. The can seal 110 includes a central opening, which is sized to admit the piercing element 135 of the piercing tube 130 when in a can engagement position. Hence, the piercing element 135 can slide through the can seal 110 to pierce the beverage can. The can seal 110 can then seal the resulting puncture and can serve to mitigate the flow of beverage from escaping around the edges of the piercing tube 130. As such, the can seal 110 may prevent spillage in some examples. The beverage shotgunning drinking apparatus 100 can also include an o-ring 131 that extends around the distal end 130B of the piercing tube 130. The o-ring 131 serves to mitigate the flow of beverage from escaping between an outer wall 130E of the piercing tube 130 and the inner wall of the cylindrical passage 120C of the body shell 120. The can seal 110 and the o-ring 131 can be made of any material capable of forming a seal, such as a rubber or silicone.

The beverage shotgunning drinking apparatus 100 may also include a key ring attachment 150, which can be employed for placing the beverage shotgunning drinking apparatus 100 into a stowed position when not in use. The key ring attachment 150 may include a clip for attaching to a key. The key ring attachment 150 also includes a semi-circular clip sized to extend at least partially around, and couple to, an outer wall 130E of the piercing tube 130. For example, the key ring attachment 150 can clip around the second diameter 137 of the piercing tube 130 and abut the drinking spout 133 of the piercing tube 130. The key ring attachment 150 can also abut the distal end 120B of the body shell 120. This results in partially contracting the compression spring 143 and drawing the piercing element 135 inside the proximate end 120A of the body shell 120 without fully arming the beverage shotgunning drinking apparatus 100. The pressure from the compression spring 143 can assist in maintaining the key ring attachment 150 in position. Further, by pressing on both the distal end 120B of the body shell 120 and the drinking spout 133 of the piercing tube 130, the key ring attachment 150 can maintain the piercing tube in the stowed position. The key ring attachment 150 can be made of any material capable of maintaining a predetermined shape when under pressure, such as when under pressure from a compression spring 143 via the piercing tube 130. For example, the key ring attachment 150 may be made of plastic, metal, wood, glass, ceramics, stone, etc.

The following FIGS. provide further explanation and context for the functionality of the components discussed above in various positions, such as the stowed position, the armed position, and the can engagement position.

Figure 2A:
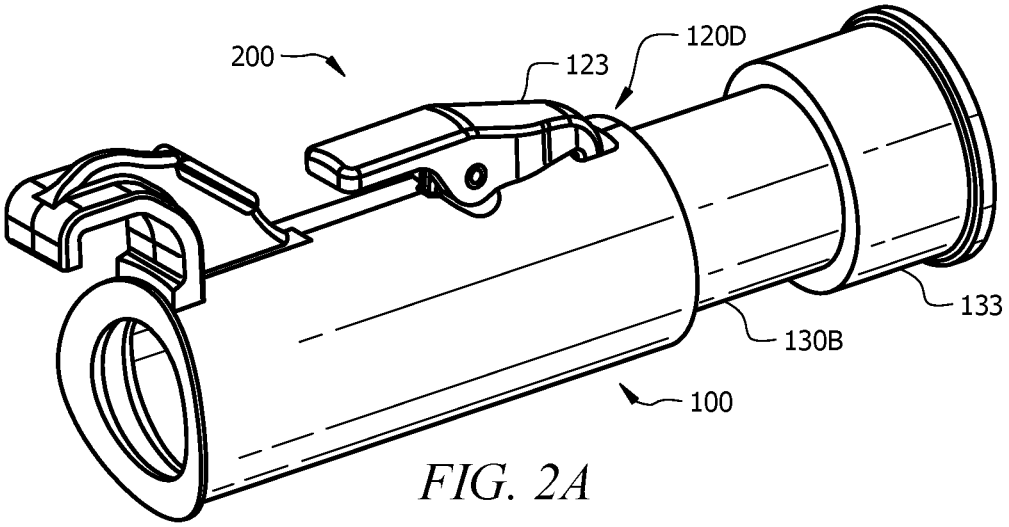
FIG. 2A is a perspective view of the example beverage shotgunning drinking apparatus in an armed position.

FIG. 2A is a perspective view of the example beverage shotgunning drinking apparatus 100 in an armed position 200. The piercing tube 130 is slidably positioned within the body shell 120. The drinking spout 133 is employed to pull against the compression spring 143, which pulls the distal end 130B of the piercing tube 130 out of the cylindrical passage 120C of the body shell 120. The trigger latch 123 is positioned to extend through the trigger opening 120D and abut against a first flange 130D of the piercing tube 130, which maintains the piercing tube 130 in the armed position relative to the body shell 120 until the trigger latch 123 is actuated.

Figure 2B:
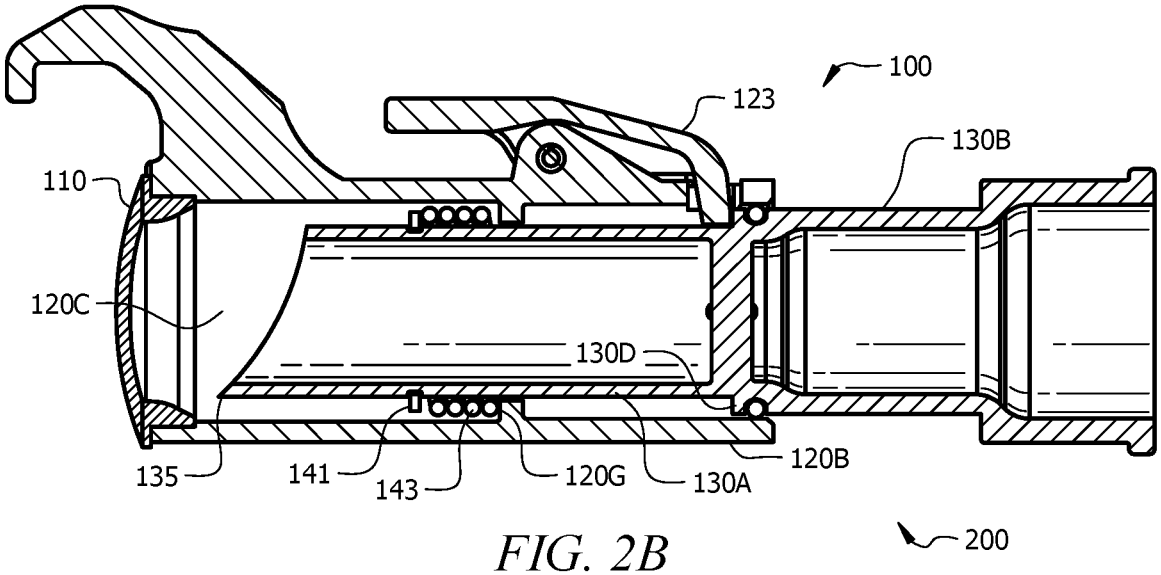
FIG. 2B is a cross-sectional view of the example beverage shotgunning drinking apparatus in the armed position.

FIG. 2B is a cross-sectional view of the example beverage shotgunning drinking apparatus 100 in the armed position 200. As shown, the trigger latch 123 abuts against a flange 130D resulting from a difference between a first diameter 136 of the proximate end 130A of the piercing tube 130 and a second diameter 137 of the distal end 130B of the piercing tube 130. Hence, the trigger latch 123 prevents the piercing tube 130 from sliding toward the can seal 110. Instead, the piercing element 135 is maintained within the cylindrical passage 120C of the body shell 120. Further, the compression spring 143 is compressed between the spring clip 141 and an inner ridge 120G of the body shell 120. This prevents the piercing tube 130 from sliding out of the distal end 120B of the body shell 120. Further, the compression spring 143 stores force that can be used to pierce a beverage can when the trigger latch 123 is actuated to release the flange 130D of the piercing tube 130.

Figure 3:
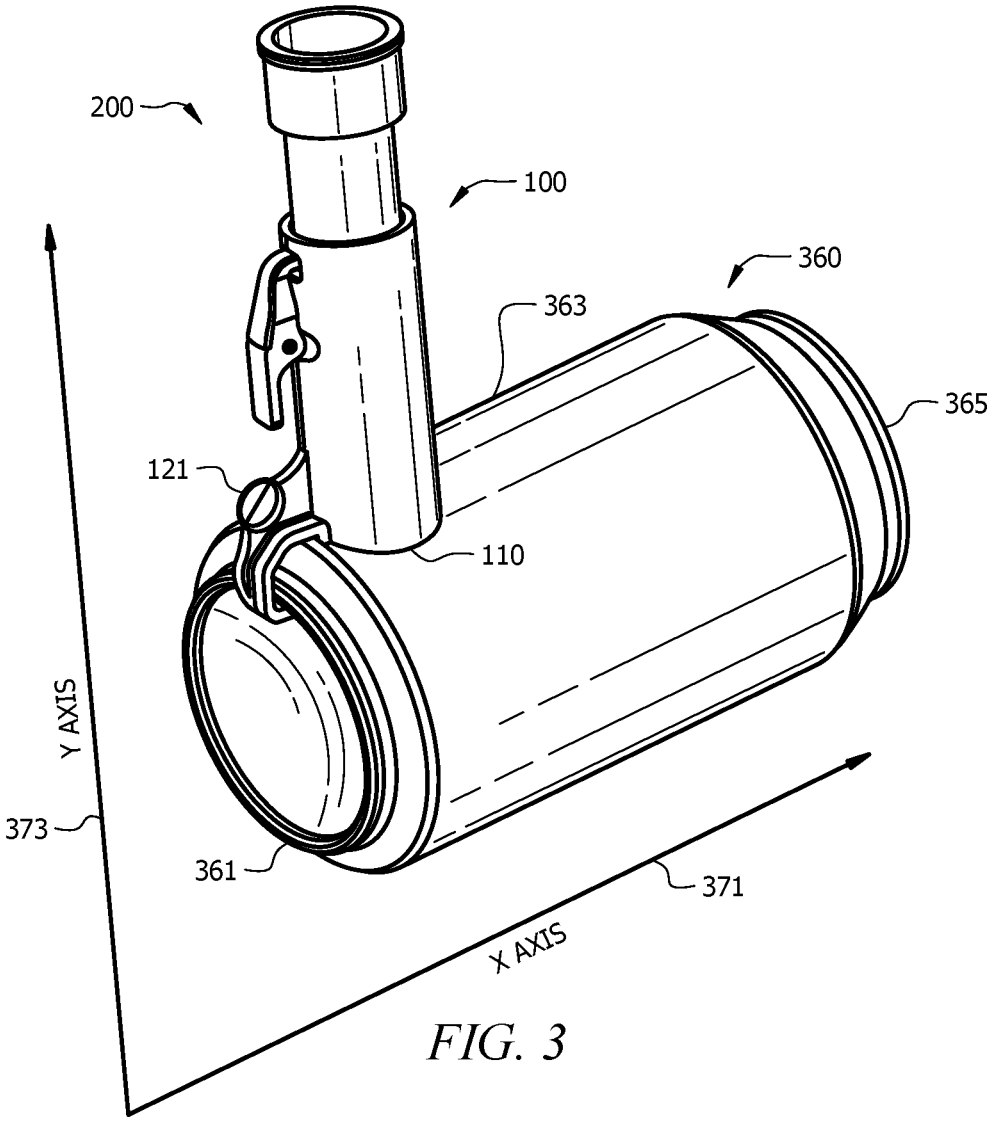
FIG. 3 is a perspective view of the example beverage shotgunning drinking apparatus in the armed position and abutting a beverage can.

FIG. 3 is a perspective view of the example beverage shotgunning drinking apparatus 100 in the armed position 200 and abutting a beverage can 360. A beverage can 360 can contain a sidewall 363, a lid 365, and a lower rim 361. The can engagement member 121 is engaged over the lower rim 361 of the beverage can 360. Further, the can seal 110 is abutted against the sidewall 363 of the beverage can 360. In this configuration, the beverage shotgunning drinking apparatus 100 is prepared for being actuated to pierce the sidewall 363 of the beverage can 360.

In order to prevent the beverage from flowing out and spilling immediately upon actuation, the beverage can 360 can be oriented horizontally relative to the ground. In this example, an x axis 371 is parallel to the earth, and a y axis 373 is oriented perpendicular to the earth. Hence, the beverage can 360 is oriented horizontally when the beverage can 360 extends along the x axis 371 with the lid 365 extending perpendicularly relative to the earth. In this position, the beverage shotgunning drinking apparatus 100 extends along the y axis 373 and is therefore oriented perpendicular to the earth.

Figure 4:
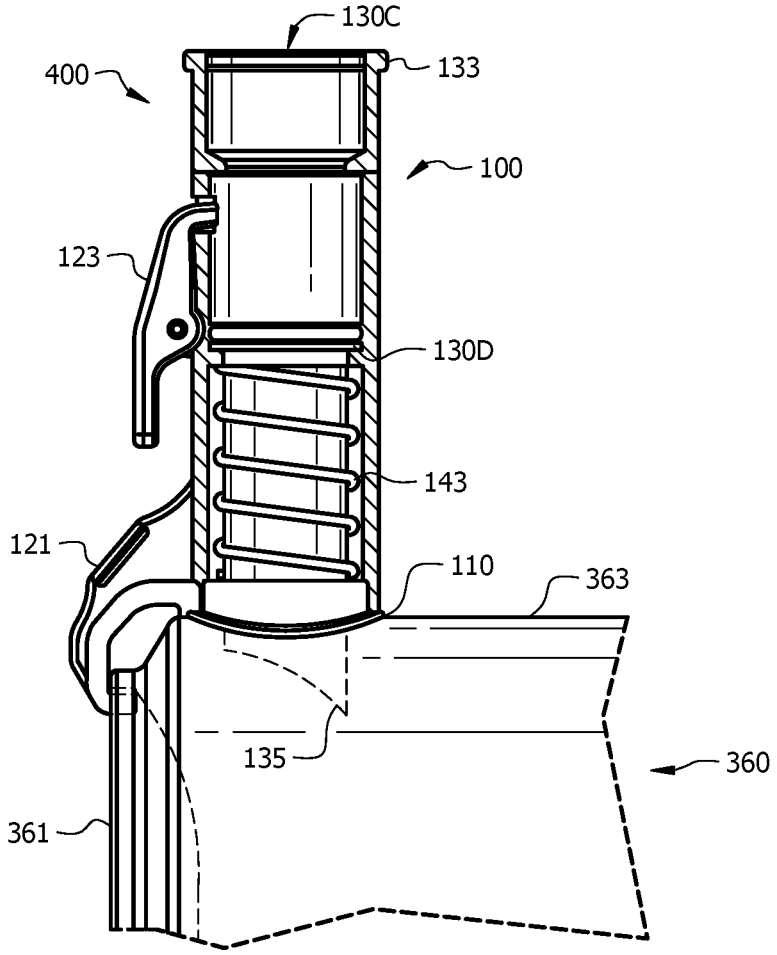
FIG. 4 is a cut away view of the example beverage shotgunning drinking apparatus in a can engagement position with the beverage can oriented horizontally.

FIG. 4 is a cut away view of the example beverage shotgunning drinking apparatus 100 in a can engagement position 400 with the beverage can oriented horizontally. Once the trigger latch 123 is actuated and removed from abutting the flange 130D of the piercing tube 130, the compression spring 143 forces the piercing tube 130 to slide into the beverage can 360. The piercing element 135 slides through the opening of the can seal 110 with enough force to pierce the sidewall 363 of the beverage can 360. The opening created by the piercing of the sidewall 363 provides a conduit to funnel the beverage from the beverage can 360, through the drink passage 130C, and to the drinking spout 133. The can engagement member 121 remains engaged around the lower rim 361 of the beverage can 360. Further, the piercing element 135 is held in the pierced hole in the sidewall 363 of the beverage can 360. This provides two connection points, which increases the stability of the engagement of the shotgunning drinking apparatus 100 to the beverage can 360.

Figure 5A:
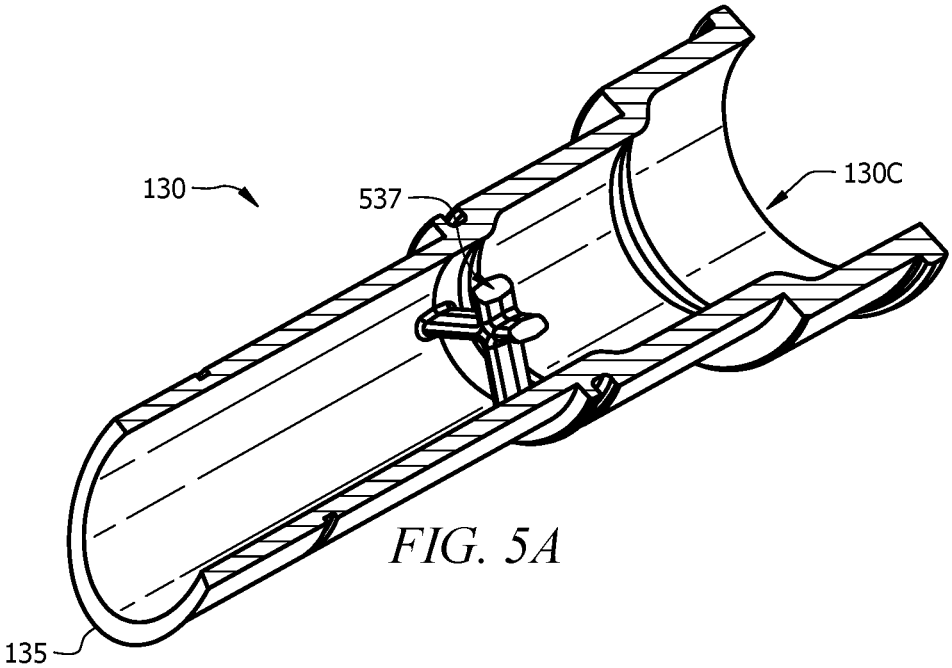
FIG. 5A is a cut away view of an example piercing tube.

FIG. 5A is a cut away view of an example piercing tube 130. The piercing tube 130 includes internal ribs 537 positioned in the drink passage 130C. The internal ribs 537 may act as a filter in the event that a metal plug is removed from the beverage can during piercing by the piercing element 135. In such an event, the metal plug is stopped by the internal ribs 537 so the user does not drink the metal plug.

The internal ribs 537 are positioned and sized to allow the beverage to flow unimpeded through the drink passage 130C and may not be used unless a large object, such as a metal plug, traverses the drink passage 130C.

Figure 5B:
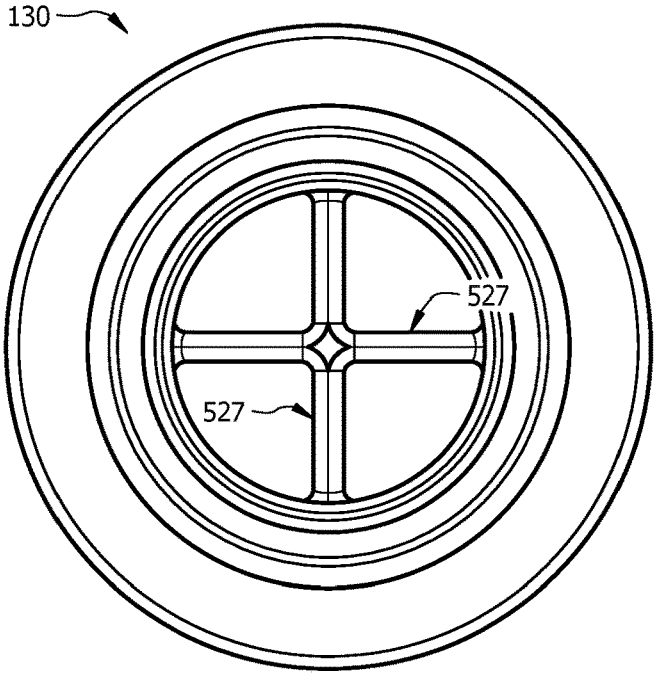
FIG. 5B is an orthogonal rear view of the example piercing tube.

FIG. 5B is an orthogonal rear view of the example piercing tube 130. As shown, the internal ribs 537 may, for example, include crossbars that extend between the internal walls of the piercing tube 130 and divide the drink passage into quadrants. The configuration of the internal ribs 537 shown provides an example mechanism for blocking beverage can metal plugs from being swallowed. However, one of skill in the art will understand that many filter types can be used in piercing tube 130 to accomplish such a purpose.

Figure 6:
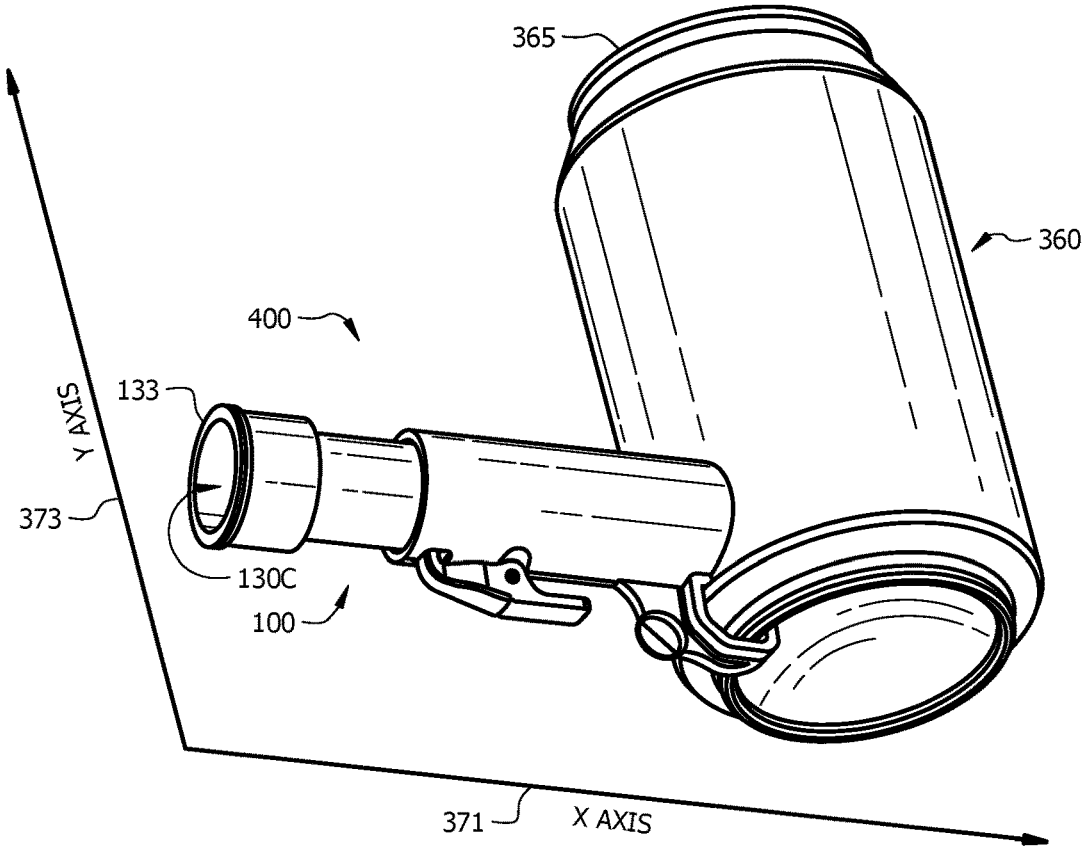
FIG. 6 is a perspective view of the example beverage shotgunning drinking apparatus in the can engagement position with the beverage can oriented vertically.

FIG. 6 is a perspective view of the example beverage shotgunning drinking apparatus 100 in the can engagement position 400 with the beverage can 360 oriented vertically. The beverage can 360 has been oriented vertically so that the beverage can 360 extends along the y axis 373, and is hence perpendicular to the earth. The beverage shotgunning drinking apparatus 100 extends along the x axis 371 and is hence parallel to the earth (oriented horizontally). This orientation allows the beverage to flow through the drink passage 130C. The user can therefore drink the beverage from the drinking spout 133. In order to shotgun the beverage, the user can also open the lid 365 of the beverage can 360 to allow air to enter the top of the beverage can 360. This continually equalizes pressure within the beverage can 360 as the beverage leaves the drinking spout 133. This in turn increases the speed that the beverage leaves the drinking spout 133. The user can therefore drink the entire beverage quickly (e.g., about five to six seconds for a twelve ounce beverage can 360).

Figure 7A:
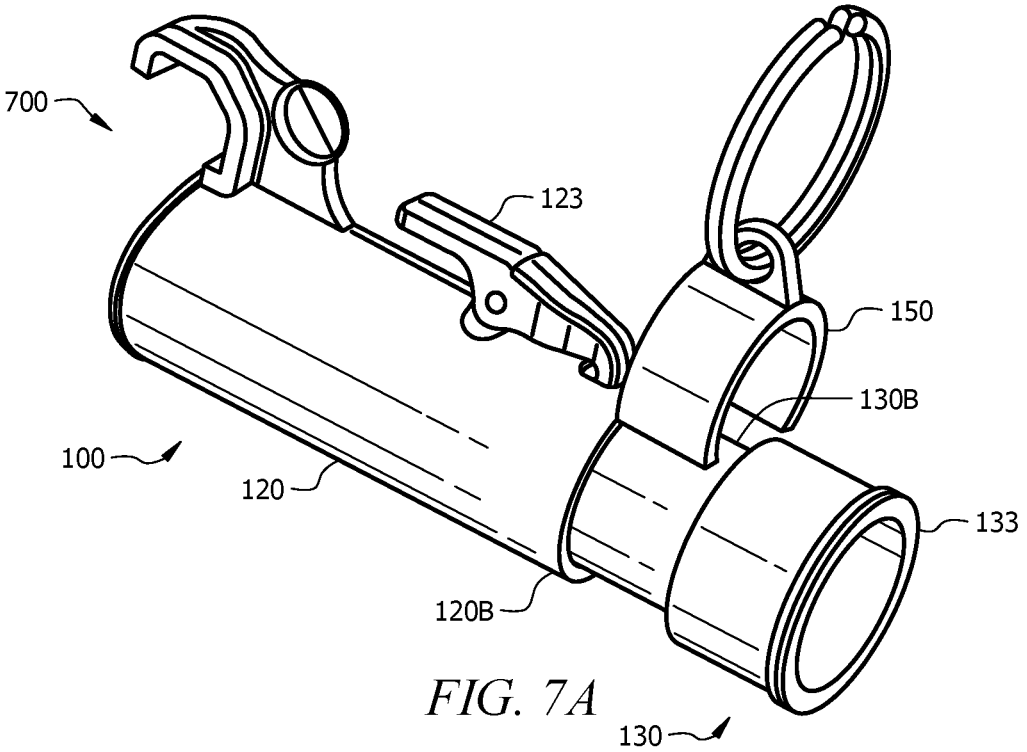
FIG. 7A is a perspective view of the example beverage shotgunning drinking apparatus in a stowed position.

FIG. 7A is a perspective view of the example beverage shotgunning drinking apparatus 100 in a stowed position 700. The drinking spout 133 is pulled from the body shell 120, which exposes the distal end 130B of the piercing tube 130. The key ring attachment 150 can then clip around the distal end 130B of the piercing tube 130. The key ring attachment 150 abuts the drinking spout 133 of the piercing tube 130 and the distal end 120B of the body shell 120, which prevents the compression spring 143 from pulling the piercing tube 130 into a can engagement position. Further, the piercing tube 130 may not slide far enough to allow the trigger latch 123 to engage, and hence the beverage shotgunning drinking apparatus 100 is not armed when in the stowed position 700. This may prevent the piercing element 135 from accidentally extending beyond the body shell 120.

Figure 7B:
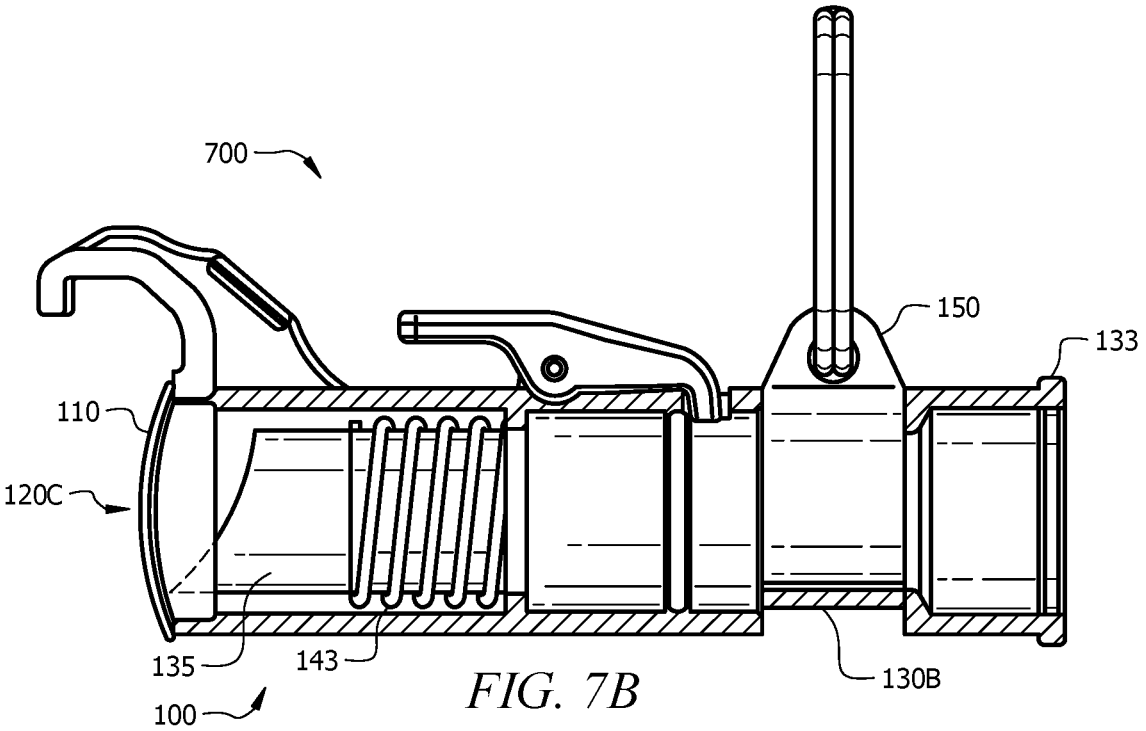
FIG. 7B is a cut away view of the example beverage shotgunning drinking apparatus in the stowed position.

FIG. 7B is a cut away view of the example beverage shotgunning drinking apparatus 100 in the stowed position 700. As shown, when the key ring attachment 150 clips around the distal end 130B of the piercing tube 130 between the drinking spout 133 and the distal end 120B of the body shell 120. This maintains the piercing element 135 within the cylindrical passage 120C of the body shell 120 and within the can seal 110. This prevents the piercing element 135 from accidentally extending beyond the body shell 120 and injuring the user when the beverage shotgunning drinking apparatus 100 is not in use. Also, the compression spring 143 is partially compressed, which creates a partial tension on the piercing tube 130. This prevents the piercing tube 130 from sliding out of the distal end 120B of the body shell 120.

Figure 8:
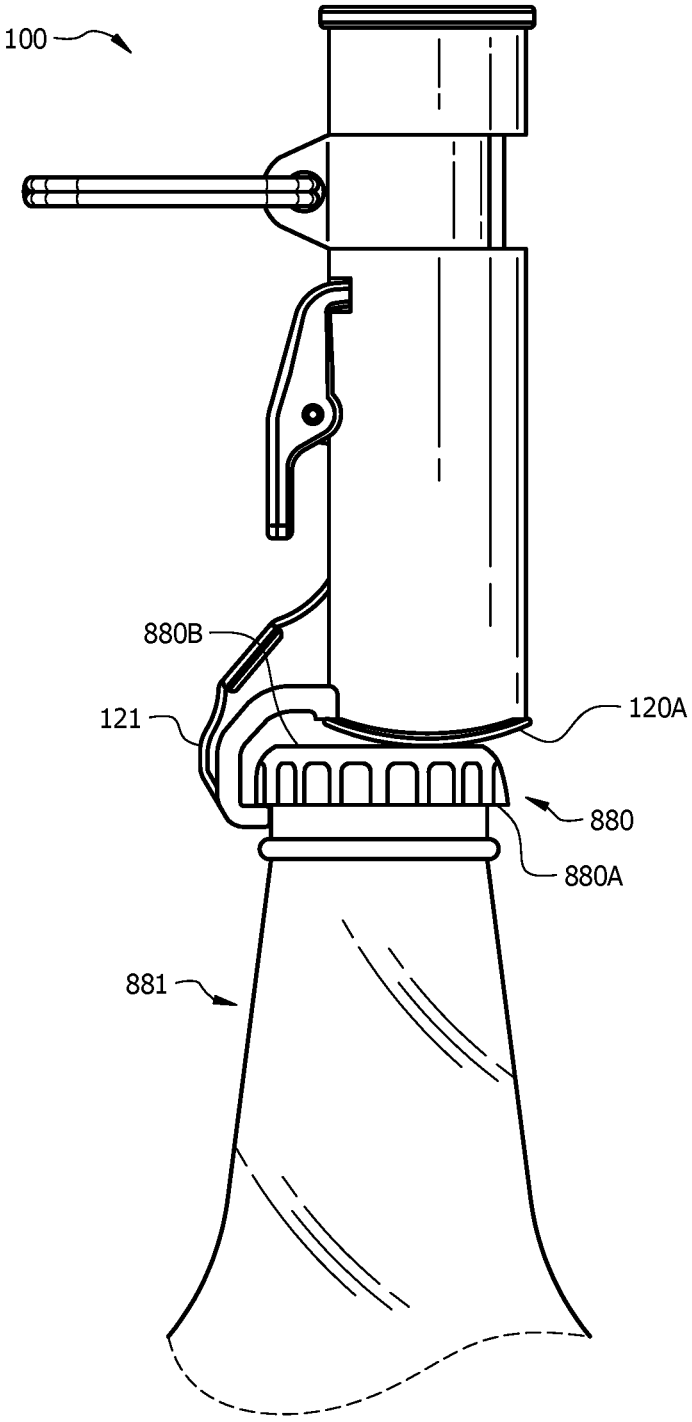
FIG. 8 is a perspective view of the example beverage shotgunning drinking apparatus abutting a bottle cap.

FIG. 8 is a perspective view of the example beverage shotgunning drinking apparatus 100 abutting a bottle cap 880. The bottle cap 880 is used to seal a bottle 881. The beverage shotgunning drinking apparatus 100 can be employed as a bottle 881 opener. The bottle cap 880 includes a lip 880A and a top face 880B. The curvature of the can engagement member 121 is sized to engage under the lip 880A of a bottle cap 880. The proximate end 120A of the body shell 120 and the can seal 110, may abut the top face 880B of the bottle cap 880. The beverage shotgunning drinking apparatus 100 can then be rotated to place force under the lip 880A of a bottle cap 880. This bends the bottle cap 880 due to the force exerted by the body shell 120 on the top face 880B of the bottle cap 880. Upon bending, the bottle cap 880 can then be removed from the bottle 881.

Figure 9:
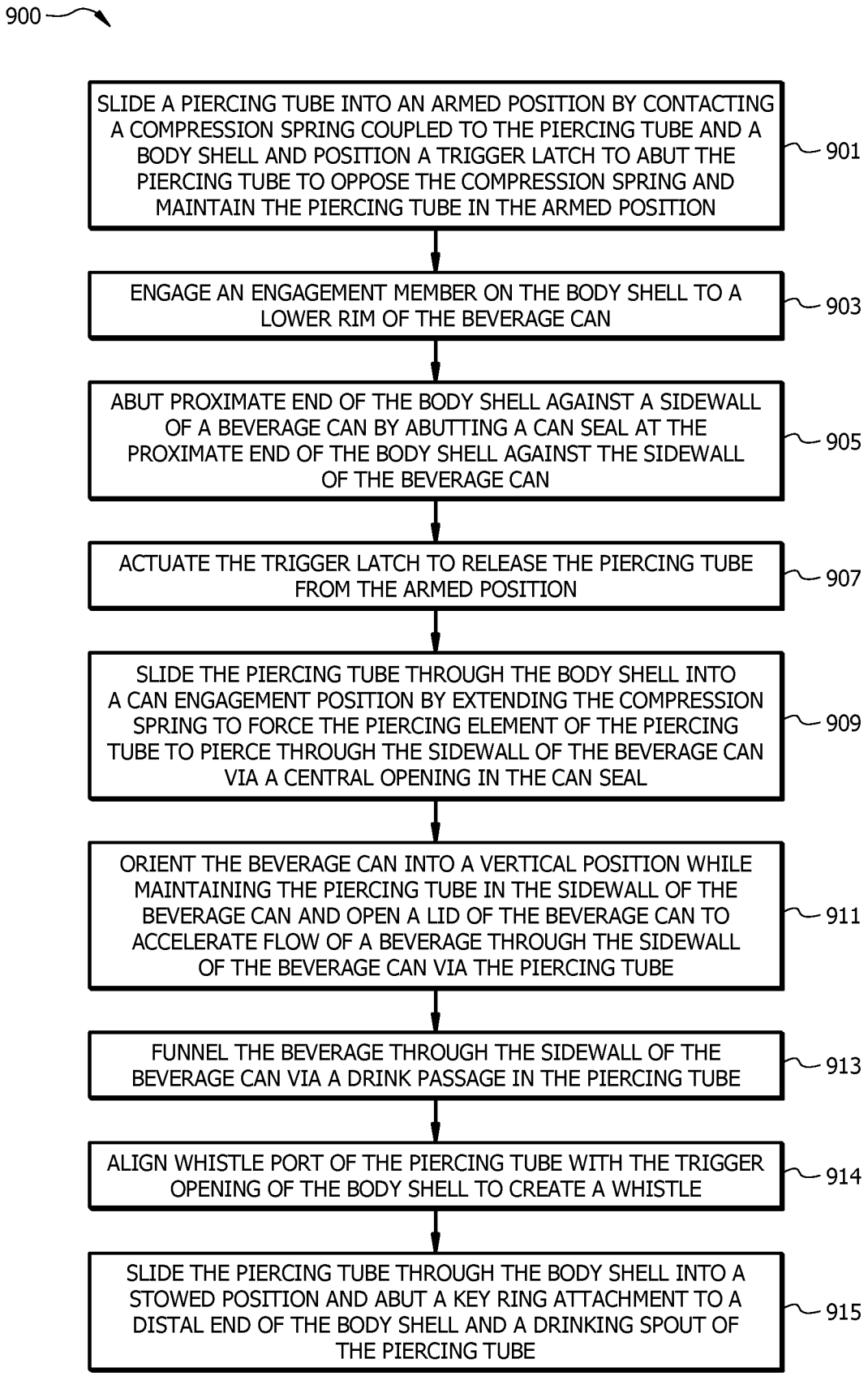
FIG. 9 is a flowchart of an example method employing the shotgunning drinking apparatus to shotgun a beverage.

FIG. 9 is a flowchart of an example method 900 employing the shotgunning drinking apparatus, such as beverage shotgunning drinking apparatus 100, to shotgun a beverage.

At block 901, a piercing tube is slid into an armed position relative to a body shell. This can be accomplished by contracting a compression spring coupled to the piercing tube and the body shell. In order to maintain the piercing tube in the armed position, a trigger latch can be positioned to abut the piercing tube and to oppose the compression spring.

At block 903, an engagement member on the body shell is engaged to a lower rim of the beverage can. The proximate end of the body shell is then abutted against the sidewall of the beverage can at block 905. This may include abutting a can seal at the proximate end of the body shell against the sidewall of the beverage can. As noted above, the beverage can may be oriented horizontally, and the beverage shotgunning drinking apparatus 100 oriented vertically, at this point. Further, these actions result in engaging the armed beverage shotgunning drinking apparatus 100 to the beverage can.

At block 907, the trigger latch is actuated to release the piercing tube from the armed position. In response, the piercing tube slides through the body shell into a can engagement position at block 909. This results in piercing the sidewall of the beverage can with a piercing element of the piercing tube. For example, actuating the trigger latch allows the compression spring to extend at block 909, which forces the piercing element of the piercing tube through the sidewall of the beverage can. Further, when a can seal is employed, the piercing element of the piercing tube slides through the sidewall of the beverage can via a central opening in the can seal.

At block 911, the beverage can is oriented into a vertical position while the piercing tube is maintained within the sidewall of the beverage can. Further, a lid of the beverage can is opened to accelerate the flow of the beverage through the sidewall of the beverage can via the piercing tube.

At block 913, the beverage is funneled through the sidewall of the beverage can via a drink passage in the piercing tube. The user can then drink the beverage from the drink spout.

At optional block 914, the piercing tube can contain a whistle port as discussed with respect to FIG. 10 below. In one example, the shotgunning drinking apparatus can be removed from the beverage can. The trigger latch can be actuated to allow the whistle port of the piercing tube to align with the trigger opening of the body shell when the compression spring is not under tension. For example, the piercing tube can slide through the body shell until the whistle port is aligned with the trigger opening to create a whistle. Air (e.g., from a user's lips) may blow though the drink passage of the piercing tube with some amount of air exiting the whistle port and the trigger opening, resulting in a whistling sound. In another example, the shotgunning drinking apparatus can remain engaged with the beverage can when the trigger latch is actuated. This allows air to flow through the piercing tube, into the beverage can, and out of the lid of the beverage can, which results in a whistling sound. For example, a user may shotgun a beverage and blow the whistle to indicate that the beverage has been consumed (e.g., to end a competition).

At block 915, the beverage has been consumed, and the shotgunning drinking apparatus may be placed in a stowed position. For example, the piercing tube is slid through the body shell into a stowed position. A key ring attachment is then abutted to a distal end of the body shell and a drinking spout of the piercing tube, which maintains the piercing tube in the stowed position.

Figure 10:
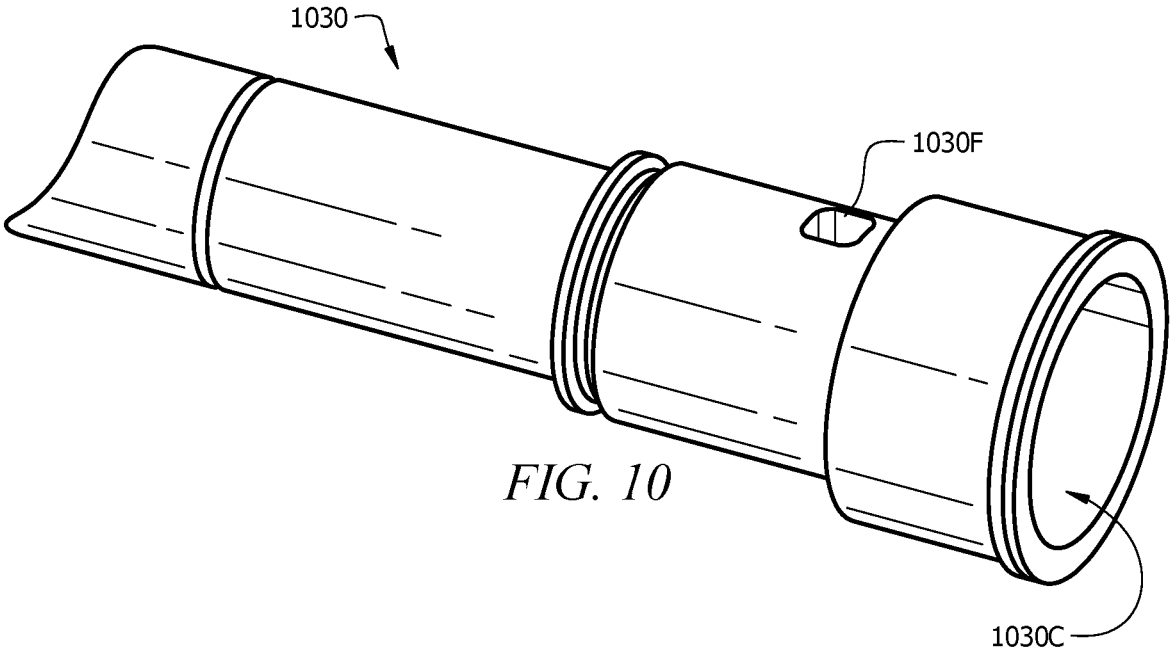
FIG. 10 is a perspective view of an example piercing tube configured as a whistle.

FIG. 10 is a perspective view of an example piercing tube 130 configured as a whistle. The piercing tube 1030 is substantially similar to piercing tube 130, but also contains whistle port 1030F. The piercing tube 1030 is an alternative example of a piercing tube 130, and hence can be employed in conjunction with a body shell 120 and other components as shown in FIG. 1. The whistle port 1030F is positioned to align with a trigger opening 120D when the compression spring 143 is not under tension, for example as occurs in the can engagement position 400. In this example, the trigger latch 123 can be rotated to extend through the trigger opening 120D and the whistle port 1030F when the shotgunning a beverage to prevent the beverage from escaping from the whistle port 1030F. When not used for shotgunning, the trigger latch 123 can be actuated to open the whistle port 1030F and the trigger opening 120D. This allows air to move through a drink passage 1030C of the piercing tube 1030 while allowing some air to exit the whistle port 1030F, causing a whistling sound.

A first component is directly coupled to a second component when there are no intervening components or another medium between the first component and the second component. The first component is indirectly coupled to the second component when there are intervening components or another medium between the first component and the second component. The term "coupled" and its variants include both directly coupled and indirectly coupled.

While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, components, techniques, or methods without departing from the scope of the present disclosure. Other examples of changes, substitutions, and alterations are ascertainable by one skilled in the art and may be made without departing from the spirit and scope disclosed herein.

What is claimed is:

1. An apparatus comprising:

a body shell including an outer wall, a proximate end, a distal end, a passage, and a trigger opening;

a piercing tube slidably positioned within the passage of the body shell, the piercing tube including:

a first flange;

a proximate end including a piercing element with a central opening, the proximate end including a first diameter adjacent to the piercing element;

a distal end with a second diameter, the distal end including a drinking spout with a third diameter, wherein the first diameter is smaller than the second diameter, and wherein the second diameter is smaller than the third diameter; and a drink passage between the central opening of the piercing element and the drinking spout; and a trigger latch rotatably coupled to the outer wall of the body shell and operable to extend through the trigger opening to abut the piercing tube and maintain the piercing tube in an armed position, wherein the trigger latch abuts the first diameter of the proximate end of the piercing tube and the first flange of the piercing tube when the piercing tube is in the armed position.

2. The apparatus of claim 1, further comprising a compression spring coupled to the body shell and the piercing tube, the compression spring providing tension when the piercing tube is in the armed position to bring the piercing tube into a can engagement position.

3. The apparatus of claim 1, wherein the piercing tube includes a whistle port.

4. The apparatus of claim 1, further comprising a can seal attached to the proximate end of the body shell, the can seal including a central opening sized to admit the piercing tube when in a can engagement position.

5. The apparatus of claim 1, wherein the body shell includes a can engagement member on an outer wall of the proximate end of the body shell, the can engagement member including a curvature sized to engage a lower rim of a beverage can.

6. The apparatus of claim 5, wherein the curvature of the can engagement member is further sized to engage a lip of a bottle cap and the proximate end of the body shell is configured to abut a top face of the bottle cap.

7. The apparatus of claim 1, further comprising a key ring attachment coupled to an outer wall of the piercing tube to maintain the piercing tube in a stowed position, the key ring attachment abutting the distal end of the body shell and the drinking spout of the piercing tube.

8. The apparatus of claim 1, wherein the piercing tube further includes internal ribs positioned in the drink passage.

9. The apparatus of claim 1, wherein the trigger latch abuts the second diameter of the distal end of the piercing tube when the piercing tube is in a can engagement position.

* * * * *